US007704290B2

(12) United States Patent
Oh

(10) Patent No.: US 7,704,290 B2
(45) Date of Patent: Apr. 27, 2010

(54) CYCLONE DUST COLLECTING APPARATUS FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 605 days.

(21) Appl. No.: 11/600,897

(22) Filed: Nov. 16, 2006

(65) Prior Publication Data

US 2007/0220842 A1 Sep. 27, 2007

(30) Foreign Application Priority Data

Mar. 24, 2006 (KR) ..... 10-2006-0026904

(51) Int. Cl.
*B01D 41/00* (2006.01)

(52) U.S. Cl. ..... 55/295; 55/337; 55/413; 55/416; 55/297; 55/304; 55/DIG. 3; 55/298; 15/353; 15/352; 15/283

(58) Field of Classification Search ..... 55/295, 55/DIG. 3, 337, 413, 416, 298, 297, 304; 15/353, 352, 283
See application file for complete search history.

(56) References Cited

U.S. PATENT DOCUMENTS

| | | | | |
|---|---|---|---|---|
| 786,549 | A * | 4/1905 | Dion | 210/413 |
| 5,603,740 | A | 2/1997 | Roy | 55/283 |
| 6,625,845 | B2 * | 9/2003 | Matsumoto et al. | 15/353 |
| 6,928,692 | B2 * | 8/2005 | Oh et al. | 15/352 |
| 7,351,269 | B2 * | 4/2008 | Yau | 55/297 |
| 7,419,520 | B2 * | 9/2008 | Lee et al. | 55/282 |
| 2003/0159235 | A1 | 8/2003 | Oh | 15/352 |
| 2003/0159236 | A1 | 8/2003 | Oh | 15/352 |
| 2003/0208879 | A1 * | 11/2003 | Oh et al. | 15/352 |
| 2004/0163206 | A1 * | 8/2004 | Oh | 15/353 |
| 2005/0132528 | A1 * | 6/2005 | Yau | 15/344 |
| 2006/0042202 | A1 * | 3/2006 | Lee et al. | 55/289 |
| 2008/0047239 | A1 * | 2/2008 | Zheng et al. | 55/337 |

FOREIGN PATENT DOCUMENTS

| | | |
|---|---|---|
| DE | 19704468 | 8/1998 |
| EP | 1136028 | 3/2001 |
| EP | 1547510 | 6/2005 |
| EP | 1574160 | 9/2005 |

(Continued)

OTHER PUBLICATIONS

Office Action dated Dec. 25, 2007 corresponding to Russian Patent Application No. 2006144294.

(Continued)

*Primary Examiner*—Jason M Greene
*Assistant Examiner*—Dung Bui
(74) *Attorney, Agent, or Firm*—Ohlandt, Greeley, Ruggiero & Perle, L.L.P.

(57) ABSTRACT

A cyclone dust collecting apparatus for a vacuum cleaner according to the present disclosure includes a cover having a suction port forcing entering air to form a whirling air current; a cyclone body connected to the cover, the cyclone body having a discharging pipe discharging the entered air; a grill disposed at the discharging pipe; and a grill cleaning unit movably disposed at the discharging pipe so as to remove dust attached to the grill.

21 Claims, 9 Drawing Sheets

FOREIGN PATENT DOCUMENTS

| | | |
|---|---|---|
| EP | 1629761 | 3/2006 |
| FR | 2852810 | 10/2004 |
| GB | 2388307 | 11/2003 |
| GB | 2389064 | 12/2003 |
| KR | 1020020004576 | 1/2002 |
| KR | 100512624 | 8/2005 |
| RU | 2036019 | 5/1995 |
| SU | 1443972 | 12/1988 |

OTHER PUBLICATIONS

Office Action dated Feb. 5, 2008 corresponding to Australian Patent Application No. 2006246452.
Extended Search Report dated Jun. 20, 2008 corresponding to European Patent Application No. 07290229.9.

* cited by examiner

CYCLONE DUST COLLECTING APPARATUS FOR VACUUM CLEANER

CROSS-REFERENCE TO RELATED APPLICATIONS

This application claims the benefit under 35 U.S.C. § 119 (a) from Korean Patent Application No. 10-2006-0026904 filed Mar. 24, 2006 in the Korean Intellectual Property Office, the disclosure of which is incorporated herein by reference in its entirety.

BACKGROUND OF THE INVENTION

1. Field of the Invention

The present disclosure relates to a cyclone dust collecting apparatus for a vacuum cleaner.

2. Description of the Related Art

Generally, cyclone type dust collecting apparatuses have a body with a suction path forcing dust-laden air to form a whirling air current, a discharging pipe discharging air having dust separated from the dust-laden air to a suction motor, and a grill member disposed at the discharging pipe.

In other words, the dust-laden air entering the body through a suction port turns along an inner surface of the body, thereby forming the whirling air current. The dust-laden air is centrifugally separated into dust and air by the centrifugal force generated by the whirling air current.

The separated dust is separately discharged and collected through a dust-discharging opening in fluid communication with a bottom surface of the body or an outer circumferential surface of the body by own weight of the separated dust. The air having dust separated is discharged to the suction motor through the discharging pipe formed at a center of the body.

The grill member, which filters hair or fiber dust not separated by the whirling air current, is provided at the discharging pipe. The grill member is generally formed in a mesh shape with a plurality of ribs to cross each other.

However, the hair and/or fiber dust is likely to be tangled each other so that the hair and/or fiber dust often tangles each other and entangles itself with the grill member. When the hair and/or fiber dust is tangled with the grill member, the tangled hair and/or fiber dust obstructs the flow of air so that the suction force may be decreased. Therefore, the grill member is required to clean. For this, when dumping out dust collected in the dust collecting apparatus, users should clean the grill member. When users turn down and shake a dust collecting receptacle, large dust may be easily dumped out, but the hair and/or fiber dust tangled with the grill member may be not easily separated. As a result, the users should remove the dust such as hair, fiber dust, and so on tangled with the grill member by their hands, which is unsanitary and troublesome for the users.

SUMMARY OF THE INVENTION

The present disclosure has been developed in order to overcome the above drawbacks and other problems associated with the conventional arrangement. An aspect of the present disclosure is to provide a cyclone dust collecting apparatus that can easily remove dust such as hair, thread, and so on tangled with the grill member.

The above aspect and/or other feature of the present disclosure can substantially be achieved by providing a cyclone dust collecting apparatus for a vacuum cleaner, which includes a cover having a suction port forcing entering air to form a whirling air current; a cyclone body connected to the cover, the cyclone body having a discharging pipe discharging the entered air; a grill disposed at the discharging pipe; and a grill cleaning unit movably disposed at the discharging pipe so as to remove dust attached to the grill. In some embodiments, the grill cleaning unit can include a cleaner body movably disposed inside the discharging pipe, while in other embodiments the cleaner body movably disposed outside the discharging pipe.

The grill includes a grill body connected to the discharging pipe; a cleaning hole formed at a center of the grill body; a cone with a sharp point projected above the cleaning hole; and a mesh net disposed at an opening part of the grill body except the cleaning hole.

The cleaning hole is supported by a plurality of ribs extending from an inner circumferential surface of the grill body.

The cone is formed of four bars extending from the cleaning hole and meeting each other at one point.

The grill is formed in a single piece.

According to the first embodiment of the present disclosure, the grill cleaning unit includes: a cleaner body having a space thereinside; a weighty member disposed to the space; and dust removing arms extending upward from the cleaner body.

The weighty member is a sphere of a metallic material having heavy weight such as iron, lead, and so on.

Each of the dust removing arms comprises a dust removing bar formed in any shape among a bar shape, a V shape, and a serrated shape at an end thereof.

According to the second embodiment of the present disclosure, the grill cleaning unit includes a cleaner body; and dust removing arms extending upward from the cleaner body.

The cleaner body is made of a heavy metallic material such as iron, lead, and so on.

Each of the dust removing arms comprises a dust removing bar formed in any shape among a bar shape, a V shape, and a serrated shape at an end thereof.

The discharging pipe further may include at least one guiding pin for guiding a reciprocating motion of the grill cleaning unit.

In this embodiment, the grill cleaning unit includes a cleaner body having a space thereinside; a weighty member disposed at the space; dust removing arms extending upward from the cleaner body; and at least one guiding pin holder formed at the cleaner body and corresponding to the at least one guiding pin.

According to the third embodiment of the present disclosure, the grill cleaning unit movably disposed outside the discharging pipe.

In this embodiment, the grill cleaning unit includes a cleaner body of a heavy metallic material such as iron or lead; and dust removing arms extending upwards from the cleaner body and bent to a center of the grill.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined in the description, such as a detailed construction and elements thereof, are provided to assist in a comprehensive understanding of the disclosure. Thus, it is apparent that the present disclosure may be carried out without those defined matters. Also, well-known functions or constructions are omitted to provide a clear and concise description of exemplary embodiments of the present disclosure.

Figure 1:
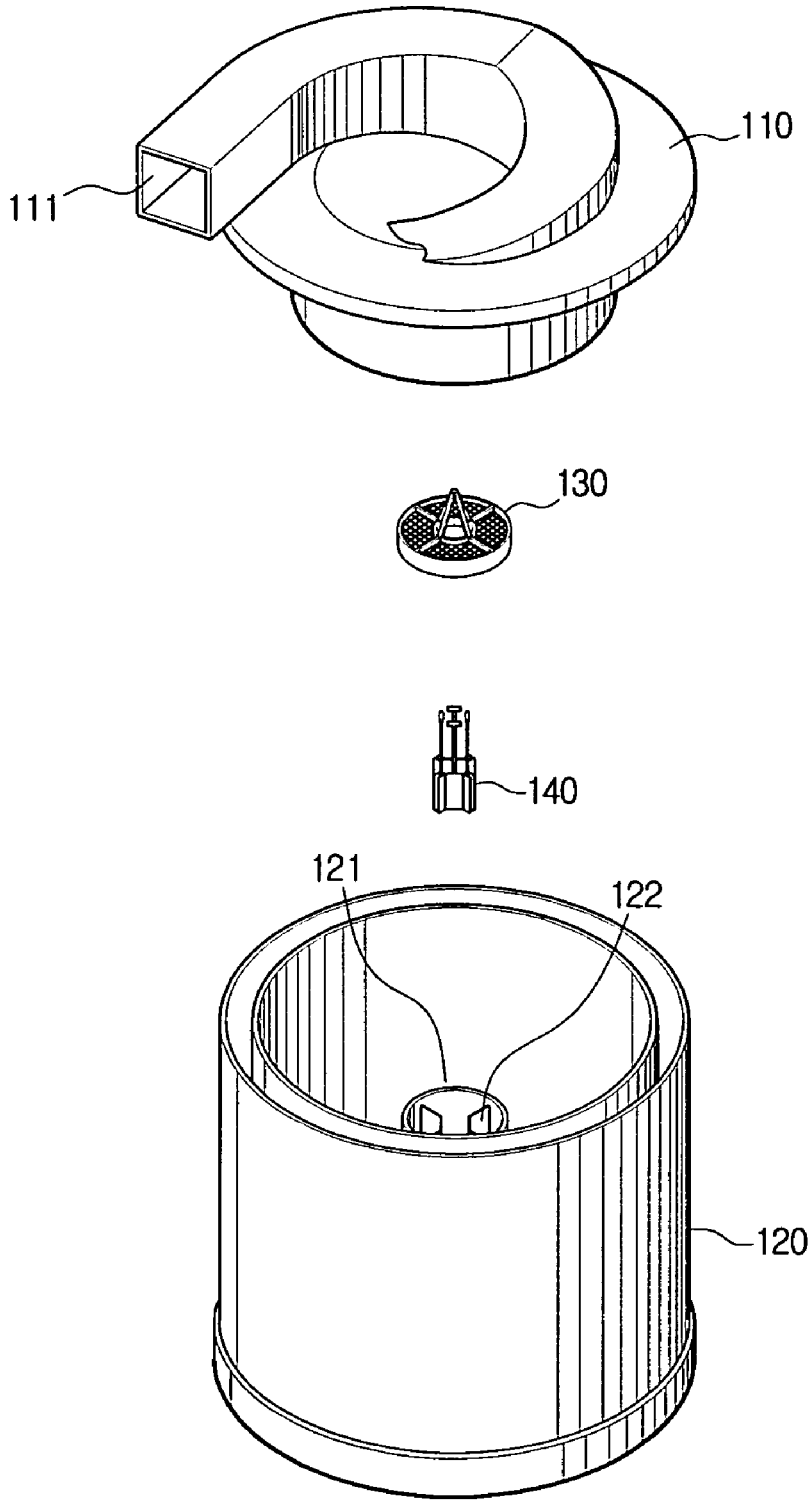
FIG. 1 is an exploded perspective view illustrating a cyclone dust collecting apparatus according to an embodiment of the present disclosure.

FIG. 1 is a perspective view illustrating a cyclone dust collecting apparatus for a vacuum cleaner according to an embodiment of the present disclosure.

Referring to FIG. 1, the cyclone dust collecting apparatus includes a cover 110, a cyclone body 120, a grill 130, and a grill cleaning unit 140.

The cover 110 has a suction port 111 that forces dust-laden air to enter the cyclone dust collecting apparatus and to form a whirling air current.

Figure 7:
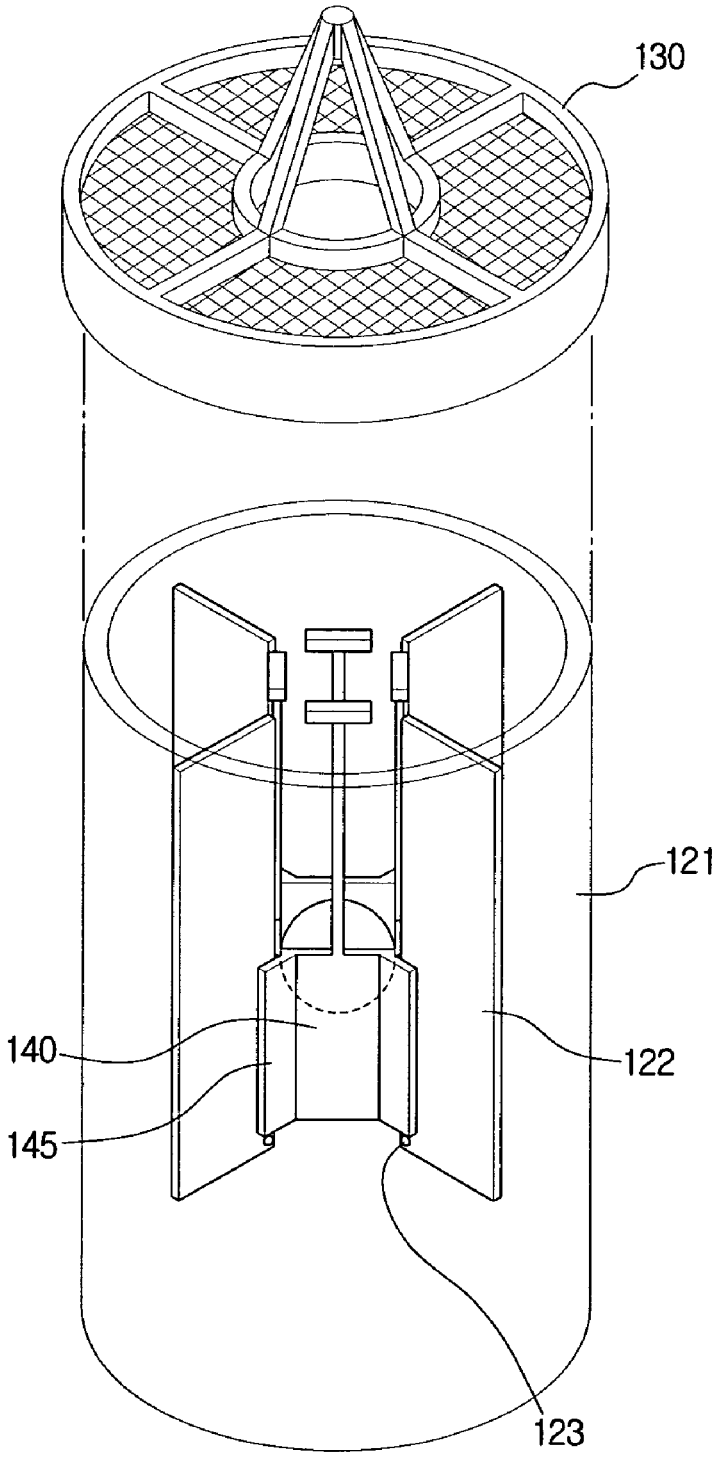
FIG. 7 is a perspective view illustrating the grill cleaning unit of FIG. 3 disposed inside a discharging pipe.

The cyclone body 120 is connected to the cover 110 and has a discharging pipe 121 disposed substantially at a center of the cyclone body 120 to discharge air entered through the suction port 111. The discharging pipe 121 is in fluid communication with a motor (not shown) to generate negative pressure for drawing-in the dust-laden air. Four (4) guiding pins 122 are disposed inside the discharging pipe 121 at angular intervals of 90° so as to guide the reciprocation motion of the grill cleaning unit 140. A limiting projection 123 (FIG. 7) is formed at an end of each of the guiding pins 122 so as to limit the movement of the grill cleaning unit 140. Therefore, the limiting projection 123 prevents the grill cleaning unit 140 from reaching a bottom surface of the cyclone dust collecting apparatus when using the vacuum cleaner.

The grill 130 is disposed at the discharging pipe 121 so as to filter once more the air discharged from the cyclone body 120 to the motor.

Figure 2:
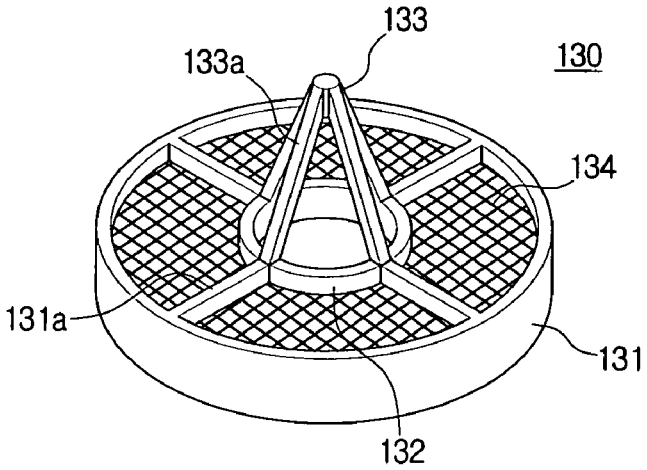
FIG. 2 is a perspective view illustrating a grill disposed at a discharging pipe of FIG. 1.

Referring to FIG. 2, the grill 130 includes a grill body 131, a cleaning hole 132, a cone 133, and a mesh net 134.

The grill body 131 is connected to a top end of the discharging pipe 121. The cleaning hole 132 is formed at a center of the grill body 131 and supported by a plurality of ribs 131*a* extending from an inner circumferential surface of the grill body 131. The cone 134 is formed of four (4) bars 133*a* extending from the cleaning hole 132 and meeting each other at one point. The cone 133 is formed to point above the discharging pipe 121. The mesh net 134 is disposed at an opening part of the grill body 131 except the cleaning hole 132 so as to remove dust from the air passing through the opening part. The grill 130 having the above-described structure is preferably formed in a single mold piece; however this should not be considered as limiting. Alternately, a mesh net 134, which is separately formed, may be disposed at the opening part of the grill body 131.

Figure 3:
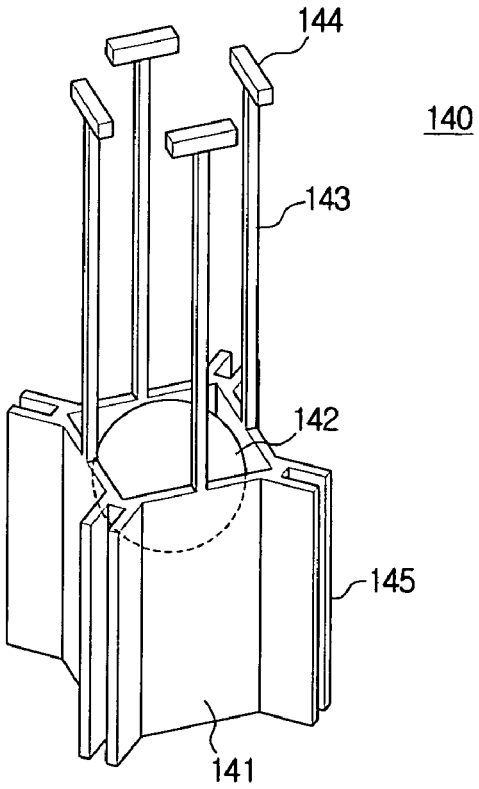
FIG. 3 is a perspective view illustrating a grill cleaning unit according to the first embodiment of the present disclosure.

Referring to FIG. 3, the grill cleaning unit 140 according to the first embodiment of the present disclosure includes a cleaner body 141, a weighty member 142, and dust removing arms 143.

The cleaner body 141 has a space thereinside. The weighty member 142, which is made of a metallic material having heavy weight such as iron, lead, and so on with a sphere shape, is disposed in the space.

Figure 4:
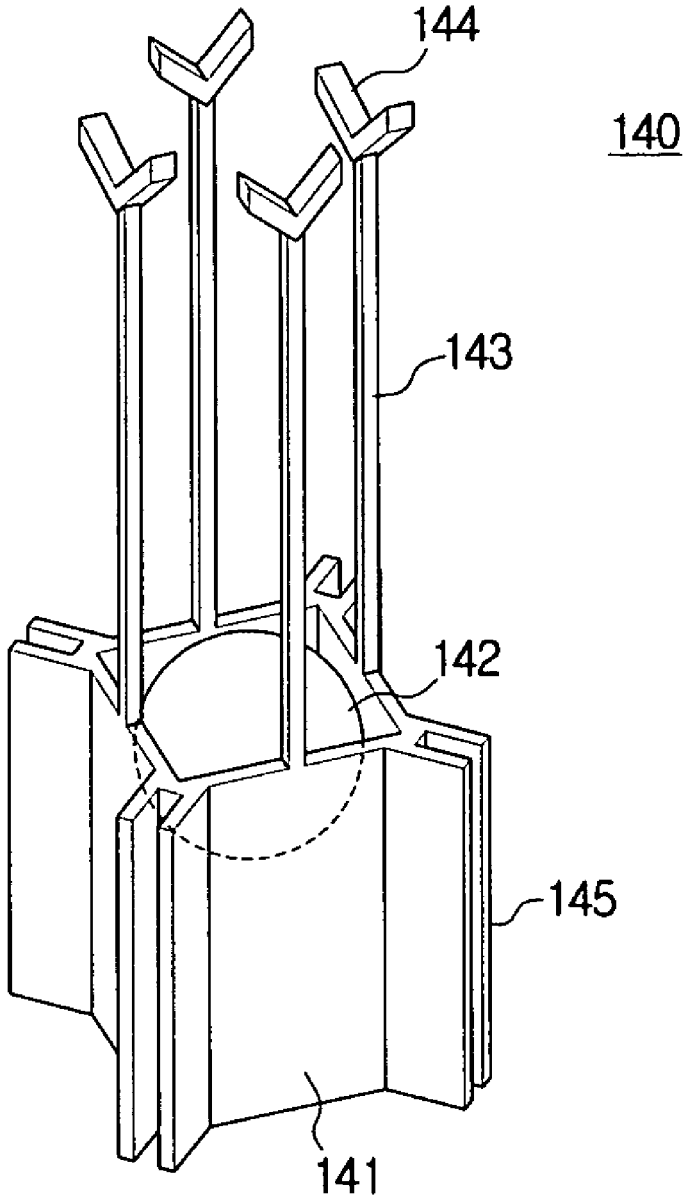
FIGS. 4 and 5 are a perspective view illustrating the grill cleaning unit of FIG. 3 having different dust removing arms, respectively.
Figure 5:
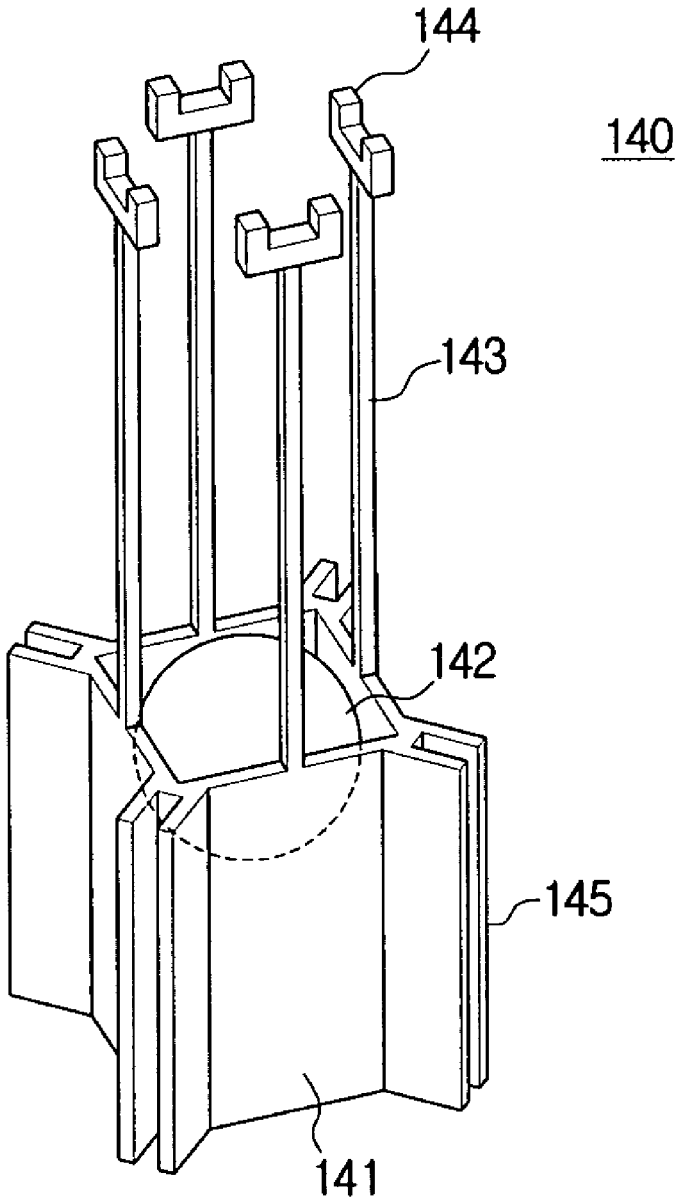

Each of the dust removing arms 143 extends upward from the cleaner body 141 and has a dust removing bar 144 at an end thereof. The dust removing bar 144 may be formed in anyone shape among a bar shape (see FIG. 3), a V shape (see FIG. 4), and a serrated shape (see FIG. 5). As long as the dust removing bar 144 can pass through openings of the cone 133, the dust removing bar 144 may be formed in various shapes including the above-described three shapes.

Figure 6:
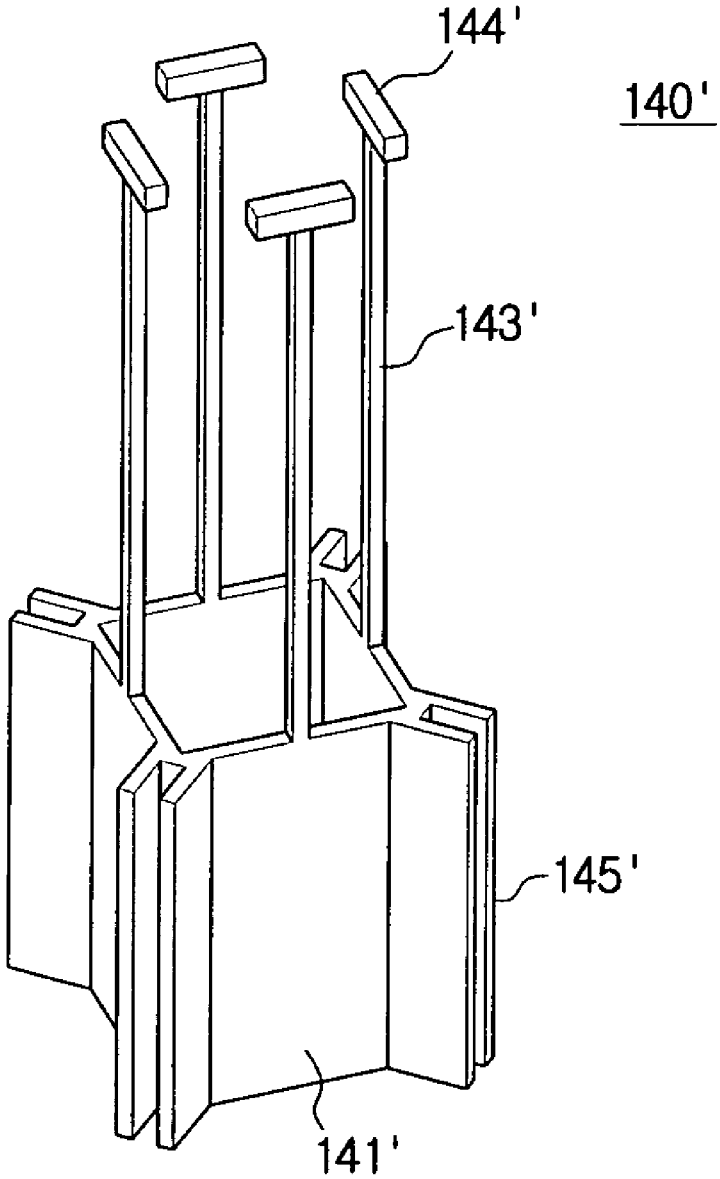
FIG. 6 is a perspective view illustrating a grill cleaning unit according to the second embodiment of the present disclosure.
Figure 9:
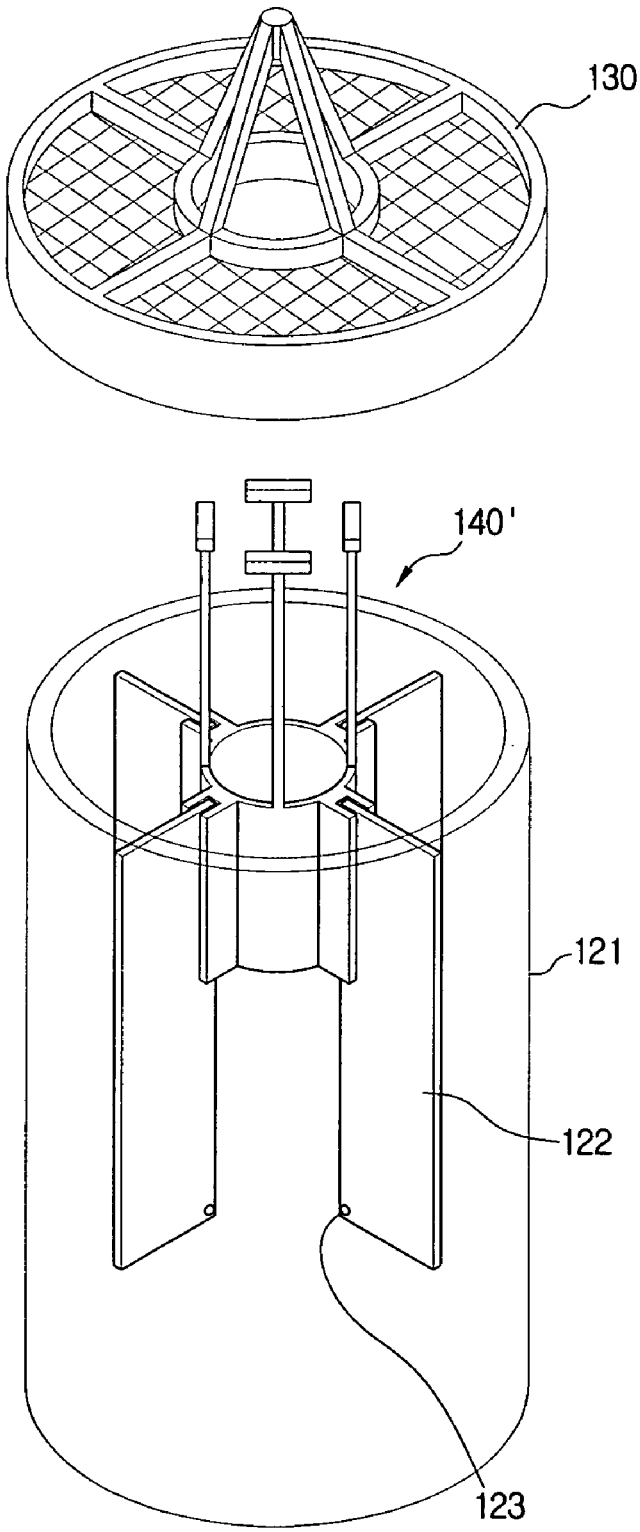
FIG. 9 is an exploded perspective view illustrating the grill cleaning unit according to the second embodiment of the present disclosure disposed inside a discharging pipe.

A grill cleaning unit 140' according to the second embodiment of the present disclosure includes a cleaner body 141', and dust removing arms 143' extending upward from the cleaner body 141' as shown in FIGS. 6 and 9.

In this embodiment, the cleaner body 141' itself is formed of a heavy metallic material such as iron, lead, and so on. The cleaner body 141' may be formed in a substantially square pipe as shown in FIG. 6 or a substantially hollow cylindrical shape as shown in FIG. 9. Thus, cleaner body 141' lacks the weighty member 142 of cleaner body 141 but functions in similar manner.

Each of the dust removing arms 143' has a dust removing bar 144' with a '-' shape at an end thereof. Although not shown, the dust removing bar 144' may have a V shape or a serrated shape like the dust removing bar 144 of the first embodiment described above.

Each of the cleaner bodies 141 and 141' according to the first and second embodiment has a plurality of guiding pin holders 145 and 145' corresponding to the guiding pins 122 formed at the inner circumferential surface of the discharging pipe 121. The plurality of guiding pin holders 145 comprises four (4) guiding pin holders at angular intervals of 90°.

Figure 10:
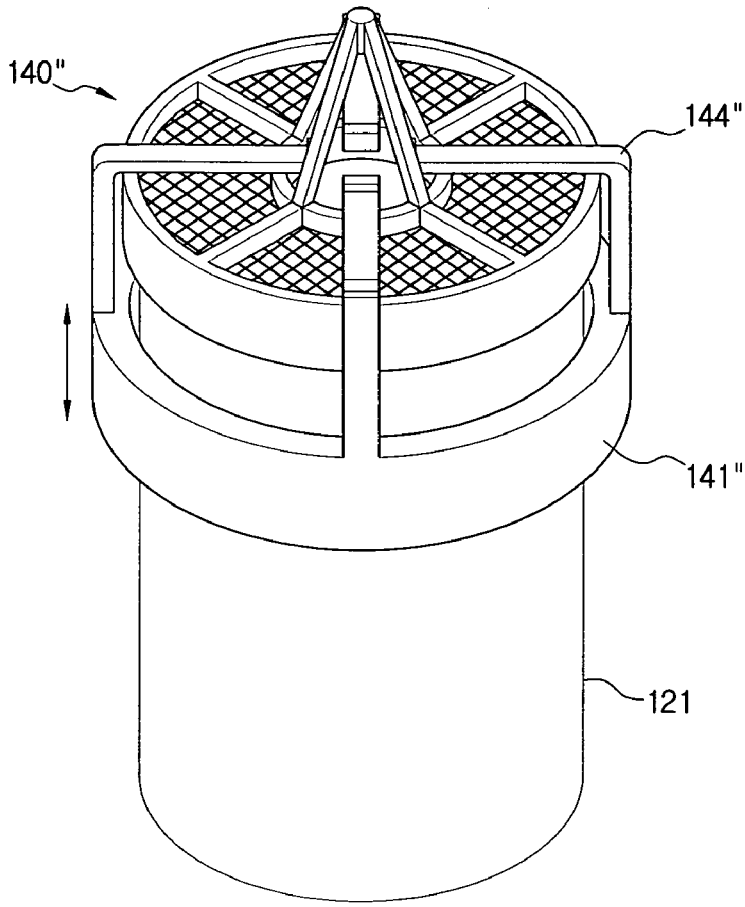
FIG. 10 is a perspective view illustrating a grill cleaning unit according to the third embodiment of the present disclosure disposed outside a discharging pipe.
Figure 11:
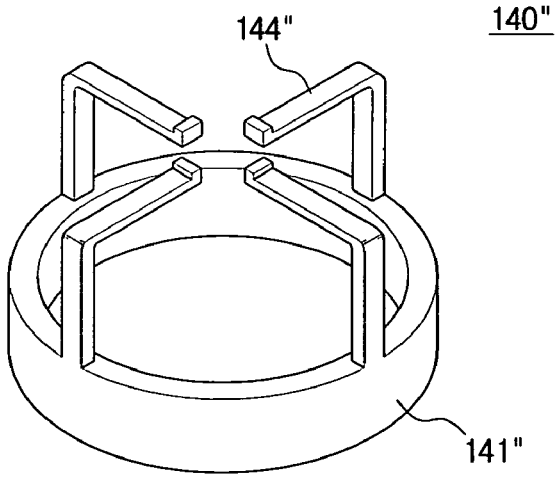
FIG. 11 is a perspective view illustrating the grill cleaning unit of FIG. 10.

A grill cleaning unit 140" according to the third embodiment of the present disclosure is movably disposed outside the discharging pipe 121 as shown in FIGS. 10 and 11. At this time, the grill cleaning unit 140" includes a cleaner body 141" made of a metallic material having heavy weight such as iron, lead, and so on, and dust removing arms 144" extending from the cleaner body 141" and bent to a center of the grill 130.

Hereinafter, operation of the cyclone dust collecting apparatus for a vacuum cleaner according to an embodiment of the present disclosure is described with reference to the accompanying drawings.

When the cyclone dust collecting apparatus is filled with dust, users separate the cyclone dust collecting apparatus from a main body of the vacuum cleaner, detach the cover 110 from the cyclone dust collecting apparatus, and then, turn the cyclone body 120 down so that the dust collected in the cyclone body 120 is dumped out.

Figure 8:
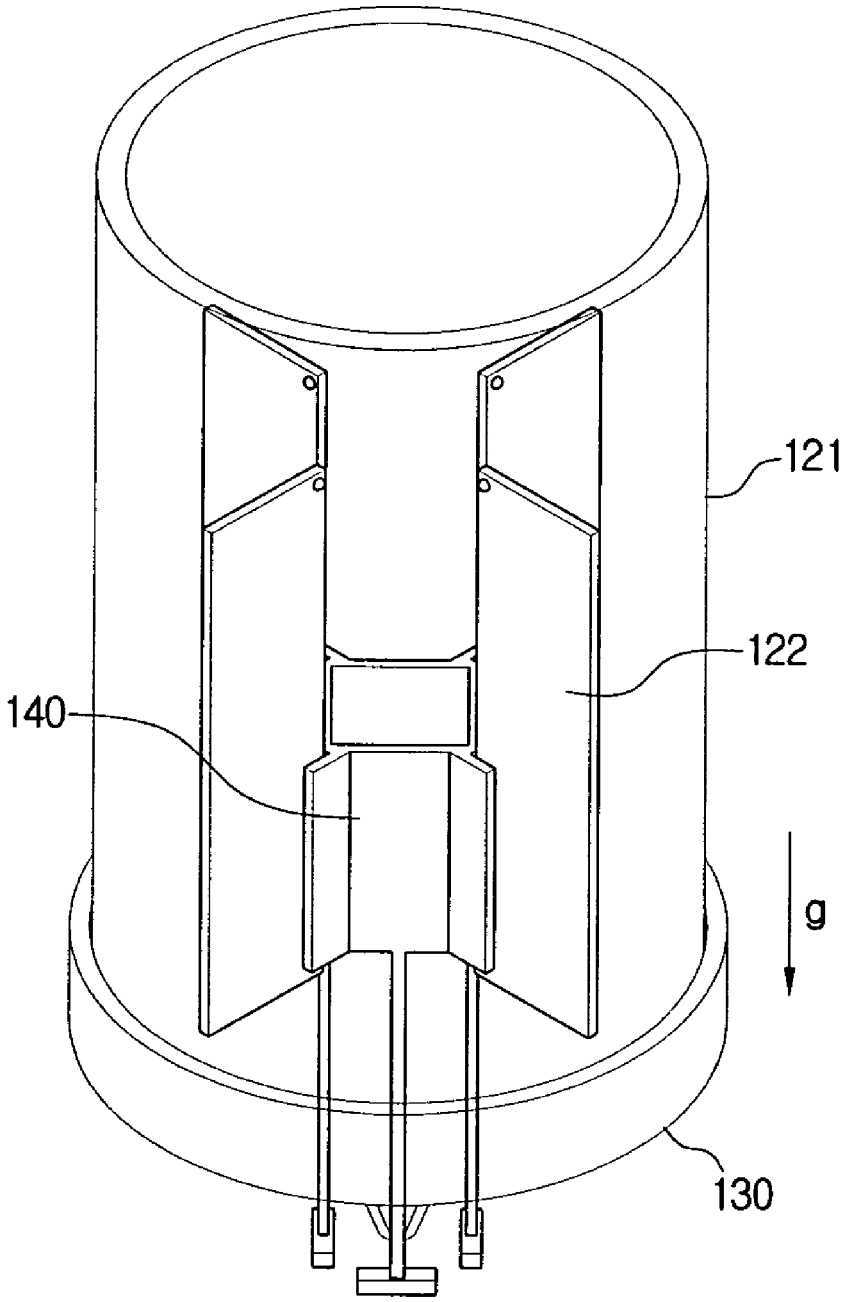
FIG. 8 is a perspective view illustrating the grill cleaning unit of FIG. 3 moved in the gravity direction when a cyclone body is turned down for emptying collected dust.

When the users turn the cyclone body 120 down to dump the collected dust out, the grill cleaning unit 140, which is movably disposed inside the discharging pipe 121, is moved in the gravity direction (the direction of arrow g in FIG. 8) along the guiding pins 122 as shown in FIG. 8. In other words, because the grill cleaning unit 140 according to the first embodiment has the weighty member 142 of a heavy metallic material such as lead and the cleaner body 141' according to second embodiment is made of the heavy metallic material, the grill cleaning unit 140 is moved downward in the gravity direction (arrow g) by the weight of the weighty member 142 or the cleaner body 141'.

When the grill cleaning unit 140 moves downward in the gravity direction, the dust removing arms 143 and the dust removing bars 144, which are extended from the cleaner body 141 and 141', pass through the openings of the cone 133 so as to remove the tangled hair or fiber dust such as thread from the grill 130. In other words, because thin and long dust such as hair is likely to be tangled with the cone 133 and the mesh net 134, the dust removing arms 143 pass through the openings of the cone 133 so as to easily separate the dust tangled with the cone 133 from the grill 130.

On the other hand, as shown in FIGS. 10 and 11, the grill cleaning unit 140" may be movably disposed outside the discharging pipe 121. When users turn down and shake the cyclone dust collecting apparatus to dump the dust collected therein out, the dust removing arms 144" bent to the grill 130 move in the direction of arrow illustrated in FIG. 10 so as to push hair and/or fiber dust tangled with the grill 130. As a result, the dust tangled with the grill 130 can be removed from the grill 130 without using users' hands.

With the cyclone dust collecting apparatus according to the present disclosure, when hair and/or fiber dust is tangled with the grill that prevents dust from flowing back to a motor side exit of the cyclone dust collecting apparatus, users turn the cyclone dust collecting apparatus down in order to dump out the dust collected therein so that the grill cleaning unit is moved downward by the own weight of itself thereby removing the dust such hair tangled with the grill.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. A cyclone dust collecting apparatus for a vacuum cleaner, comprising:

a cover having a suction port forcing entering air to form a whirling air current;

a cyclone body connected to the cover, the cyclone body having a discharging pipe discharging the entered air;

a grill disposed at the discharging pipe; and a grill cleaning unit movably disposed at the discharging pipe with respect to the grill so as to remove dust from the grill, wherein the grill cleaning unit is movably disposed inside the discharging pipe.

2. The cyclone dust collecting apparatus of claim 1, wherein the grill cleaning unit comprises:

a cleaner body having a space thereinside, the cleaner body being movably disposed inside the discharging pipe;

a weighty member disposed to the space; and dust removing arms extending upward from the cleaner body.

3. The cyclone dust collecting apparatus of claim 2, wherein the weighty member is a metallic sphere.

4. The cyclone dust collecting apparatus of claim 2, wherein each of the dust removing arms further comprises a dust removing bar formed in a shape at an end thereof, the shape being selected from the group consisting of a bar shape, a V shape, and a serrated shape.

5. The cyclone dust collecting apparatus of claim 1, wherein the discharging pipe further comprises at least one guiding pin for guiding a reciprocating motion of the grill cleaning unit.

6. The cyclone dust collecting apparatus of claim 5, wherein the grill cleaning unit comprises:

a cleaner body having a space thereinside, the cleaner body being movably disposed inside the discharging pipe;

a weighty member disposed at the space;

dust removing arms extending upward from the cleaner body; and at least one guiding pin holder formed at the cleaner body and corresponding to the at least one guiding pin.

7. The cyclone dust collecting apparatus of claim 5, wherein the grill cleaning unit comprises:

a cleaner body of a heavy metallic material such as iron or lead;

dust removing arms extending upward from the cleaner body; and at least one guiding pin holder formed at the cleaner body and corresponding to the at least one guiding pin.

8. The cyclone dust collecting apparatus of claim 1, wherein the grill cleaning unit comprises:

a cleaner body; and dust removing arms extending upward from the cleaner body.

9. The cyclone dust collecting apparatus of claim 8, wherein the cleaner body is made of a metallic material having heavy weight such as iron or lead.

10. The cyclone dust collecting apparatus of claim 9, wherein the cleaner body is movably disposed outside the discharging pipe.

11. The cyclone dust collecting apparatus of claim 9, wherein the cleaner body is movably disposed inside the discharging pipe.

12. The cyclone dust collecting apparatus of claim 11, wherein each of the dust removing arms further comprises a dust removing bar formed in a shape at an end thereof, the shape being selected from the group consisting of a bar shape, a V shape, and a serrated shape.

13. The cyclone dust collecting apparatus of claim 1, wherein the grill comprises:

a grill body connected to the discharging pipe;

a cleaning hole formed at a center of the grill body;

a cone with a sharp point projected above the cleaning hole; and a mesh net disposed at an opening part of the grill body except the cleaning hole.

14. The cyclone dust collecting apparatus of claim 13, wherein the cleaning hole is supported by a plurality of ribs extending from an inner circumferential surface of the grill body.

15. The cyclone dust collecting apparatus of claim 14, wherein the grill is formed in a single piece.

16. The cyclone dust collecting apparatus of claim 13, wherein the cone is formed of four bars extending from the cleaning hole and meeting each other at one point.

17. The cyclone dust collecting apparatus of claim 16, wherein the grill is formed in a single piece.

18. The cyclone dust collecting apparatus of claim 13, wherein the grill is formed in a single piece.

19. A cyclone dust collecting apparatus for a vacuum cleaner, comprising:

a cover having a suction port forcing entering air to form a whirling air current;

a cyclone body connected to the cover, the cyclone body having a discharging pipe discharging the entered air;

a grill disposed at the discharging pipe; and a grill cleaning unit movably disposed outside the discharging pipe so as to remove dust from the grill, wherein the grill comprises:

a grill body connected to the discharging pipe;

a cleaning hole formed at a center of the grill body;

a cone with a sharp point proiected above the cleaning hole; and a mesh net disposed at an opening part of the grill body except the cleaning hole.

20. The cyclone dust collecting apparatus of claim 19, wherein the cleaning hole is supported by a plurality of ribs extending from an inner circumferential surface of the grill body.

21. The cyclone dust collecting apparatus of claim 19, wherein the grill cleaning unit comprises:

a cleaner body of a heavy metallic material such as iron or lead; and dust removing arms extending upwards from the cleaner body and bent to a center of the grill.

* * * * *